US011266878B2

(12) United States Patent
Dornan et al.

(10) Patent No.: US 11,266,878 B2
(45) Date of Patent: Mar. 8, 2022

(54) ANALYZING SENSOR DATA ASSOCIATED WITH ATHLETIC EQUIPMENT

(71) Applicant: FRONTIER FITNESS LLC, Glenwood, MD (US)

(72) Inventors: Patrick Dornan, Philadelphia, PA (US); Ryan Harty, Loveland, CO (US)

(73) Assignee: FRONTIER FITNESS LLC, Glenwood, MD (US)

( * ) Notice: Subject to any disclaimer, the term of this patent is extended or adjusted under 35 U.S.C. 154(b) by 0 days.

(21) Appl. No.: 16/790,132

(22) Filed: Feb. 13, 2020

(65) Prior Publication Data

US 2021/0252336 A1 Aug. 19, 2021

(51) Int. Cl.

*A63B 21/072* (2006.01)
*A63B 24/00* (2006.01)
*A63B 71/06* (2006.01)

(52) U.S. Cl.

CPC ..... *A63B 24/0062* (2013.01); *A63B 21/0724* (2013.01); *A63B 71/0622* (2013.01); *A63B 2071/0647* (2013.01); *A63B 2220/40* (2013.01); *A63B 2220/52* (2013.01); *A63B 2220/833* (2013.01); *A63B 2225/15* (2013.01); *A63B 2225/54* (2013.01)

(58) Field of Classification Search

CPC ..... A63B 2024/0028; A63B 24/0062; A63B 21/724
USPC ..... 482/900
See application file for complete search history.

(56) References Cited

U.S. PATENT DOCUMENTS

| | | | | |
|---|---|---|---|---|
| 4,647,038 | A * | 3/1987 | Noffsinger | A63B 21/072 482/106 |
| 9,320,636 | B2 * | 4/2016 | Shirogauchi | A63B 24/0062 |
| 9,468,793 | B2 * | 10/2016 | Salmon | A63B 21/0724 |
| 9,623,285 | B1 * | 4/2017 | Ruiz | A61B 5/11 |
| 9,789,360 | B1 * | 10/2017 | Schaffer | A63B 24/0062 |
| 10,271,774 | B2 | 4/2019 | Eastman et al. | |
| 10,549,154 | B2 * | 2/2020 | Den Hollander | A63B 24/0003 |
| 10,729,929 | B2 * | 8/2020 | Casanova | A63B 71/0622 |
| 10,905,916 | B1 * | 2/2021 | Malik | A61B 5/1176 |
| 10,918,901 | B2 * | 2/2021 | Orfield | H04M 1/725 |

(Continued)

OTHER PUBLICATIONS

"Blast Motion", <https://store.blastmotion.com>, printed May 13, 2020, p. 1.

(Continued)

*Primary Examiner* — Alvin A Hunter
(74) *Attorney, Agent, or Firm* — Marshall, Gerstein & Borun LLP

(57) ABSTRACT

A device mountable on a shaft of exercise equipment is provided. The device comprises: a housing with a hole therethrough to receive an end of the shaft; a load sensor configured to generate an indication of weight of a load attached to the shaft; a motion sensor configured to generate an indication of motion of the load over time; and an interface configured to transmit, to an external device, (i) the indication of weight of the load and (ii) a time series descriptive of a trajectory of the load over a period of time. The external device is configured to apply a set of one or more processing rules to the indication of the weight and to the time series to generate a metric of forces applied to move the load along the trajectory and provide the metric via a user interface of a client device.

20 Claims, 13 Drawing Sheets

(56) References Cited

U.S. PATENT DOCUMENTS

| | | | | |
|---|---|---|---|---|
| 2008/0242512 | A1* | 10/2008 | Kim | A63B 21/065 482/8 |
| 2012/0165165 | A1* | 6/2012 | Iankov | A63B 21/0724 482/106 |
| 2016/0101320 | A1* | 4/2016 | Tsutsui | A63B 21/0722 482/8 |
| 2016/0346617 | A1* | 12/2016 | Srugo | G09B 19/0038 |
| 2017/0128765 | A1* | 5/2017 | Garretson | A63B 21/0724 |
| 2017/0368413 | A1* | 12/2017 | Shavit | G06K 9/00342 |
| 2018/0156657 | A1* | 6/2018 | Lee | G01C 19/00 |

OTHER PUBLICATIONS

"Bowflex", https://www.bowflex.com/selecttech/560/100581.html, printed May 13, 2020, pp. 1-3.
"Mirror", https://www.mirror.co/how-it-works, printed May 13, 2020, pp. 1-3.

* cited by examiner

ANALYZING SENSOR DATA ASSOCIATED WITH ATHLETIC EQUIPMENT

FIELD OF THE DISCLOSURE

The present disclosure generally relates to fitness tracking and, more particularly, to automatically tracking and analyzing sensor data associated with free weights.

BACKGROUND

The background description provided herein is for the purpose of generally presenting the context of the disclosure. Work of the presently named inventors, to the extent it is described in the background section, as well as aspects of the description that may not otherwise qualify as prior art at the time of filing, are neither expressly nor impliedly admitted as prior art against the present disclosure.

Many individuals lift weights to train for athletic competitions and/or to improve their overall fitness. To monitor improvements in weightlifting performance over time, individuals typically manually record information related to their workouts, such as a number of sets, a number of repetitions, a type of exercise, an amount of weight, etc., in a notebook or in a spreadsheet.

However, this self-reported weightlifting workout information may be difficult to verify (e.g., by a coach or a potential coach). For instance, an athlete on a college team or a professional team who is assigned a specific workout designed to improve his or her performance may have an incentive to inflate the length of the workout or the heaviness of weights when self-reporting information from his or her workout, e.g., to appear stronger than he or she actually is, to avoid completing a difficult or lengthy workout, etc.

Moreover, it is very difficult to account for form when self-reporting weightlifting workout information. That is, generally speaking, there are myriad ways to perform an exercise with poor form but, there generally are not common standards for describing poor form, i.e., how exactly an individual's form in performing a particular exercise differs from proper form. Moreover, there are different standards for what constitutes good form or poor form for different types of exercises and for different types of individual goals. For example, when performing a bench press exercise, the bar could touch an individual's chest between the 2nd and 3rd rib during one repetition, and between the 3rd and 4th rib in another repetition, and both repetitions would be considered to be performed with good form. However, touching the bar between the 2nd and 3rd rib is generally better for targeting the upper pectorals and touching the bar between the 3rd and 4th rib is generally better for targeting the lower pectorals Furthermore, an individual may not even know when he or she is performing an exercise with poor form. For instance, an inexperienced weightlifter may not be aware of the proper form for a given exercise. Moreover, even a weightlifter who is well aware of the proper form for a given exercise may not be sure that he or she is performing the exercise correctly. For example, a weightlifter in a home gym or otherwise in a gym without many mirrors may have difficulty seeing how he or she looks performing the exercise. Even a weightlifter in a gym with mirrors may not be able to see himself or herself from an angle that allows him or her to determine whether his or her form is correct. Moreover, some individuals may have an incentive to self-report that they performed an exercise with proper form even when they perform an exercise with poor form, e.g., as discussed above to avoid a more difficult workout.

Accordingly, there exists a need for a way to automate the collection of exercise-related data related to weight lifting in order to reduce problems caused by self-reporting and in order to more efficiently and accurately evaluate individuals' performance of various exercises and improvements thereof over time. However, using conventional methods, there is currently no way to collect exercise-related data associated with free weights, such as barbells, that automatically accounts for the variable amount of weight that an individual may add or remove from the barbell using weight plates, as well as the many different types of exercises that may be performed using a single barbell.

SUMMARY

The present disclosure provides a device associated with exercise equipment (e.g., a barbell) that captures sensor data associated with an individual's performance of an exercise using the exercise equipment. For instance, in some examples, the device may be formed such that a housing of the device may attached to the exterior of an existing "dumb" barbell or other "dumb" exercise equipment. For instance, the device may be configured to slide on to, be clasped around, be clipped to or hooked onto, be magnetically attached to, and/or be adhesively attached to the shaft of a barbell. Furthermore, in some examples, the device may be frictionally fit or clamped to the shaft of the barbell. In some examples, a barbell or other exercise equipment may be manufactured to include the device internally, or to include an internal cavity for housing the device as needed.

A load sensor (e.g., a load cell, a strain sensor, etc.) of the device may be configured to capture data indicative of the amount of weight that is loaded on the barbell during the performance of the exercise. Additionally, motion sensors (such as accelerometers and/or a gyroscopes) of the device may be configured to capture data indicative of the number of sets or repetitions the individual performs (e.g., as indicated by repetitive upwards/downwards motion during the performance of the exercise) and data indicative of the trajectory of the exercise equipment over time. In some examples, the device may include a communication interface configured to transmit data captured by the load sensor and the motion sensor(s) to a computing device. The communication interface may be further configured to capture short-range signals (e.g., Bluetooth® signals) from proximate devices to identify a user device that is nearby at times that exercises are being performed (e.g., in order to identify a particular user who is performing an exercise.)

Advantageously, the data captured by the load sensor and the motion sensor may be analyzed and processed by a processor of the computing device in order to automatically provide weightlifting workout information that accounts for the variable amount of weight that an individual may add or remove from the exercise equipment using weight plates, as well as the many different types of exercises that may be performed using the exercise equipment to a user of the computing device computing device. For instance, the analysis of the sensor data may result in weightlifting workout information, e.g., including an indication of the type of exercise being performed, which individual is performing the exercise, the amount of weight loaded on the barbell during the exercise, and a number of sets and/or repetitions performed. Moreover, the trajectory of the exercise equipment over time may be used to map the individual's form as he or she performs the exercise (e.g., as indicated by the three-dimensional trajectory of the exercise equipment in the x-y-z plane during the performance of the exercise), and this information may be provided to a user. For instance, in some examples, this weightlifting workout information provided to the user may include an animation illustrating the three-dimensional path of the exercise equipment as the individual performs a given exercise, e.g., for comparison to an expected three-dimensional path of the exercise equipment for an individual performing the exercise with proper form.

In one embodiment, a device mountable on a shaft of exercise equipment is provided. The device comprises: a housing with a hole therethrough to receive an end of the shaft; a load sensor disposed in the housing and configured to generate an indication of weight of a load attached to the shaft; a motion sensor disposed in the housing and configured to generate an indication of motion of the load at a corresponding time; and an interface disposed in the housing and configured to transmit, to an external device, (i) the indication of weight of the load and (ii) a time series descriptive of a trajectory of the load over a period of time.

In another embodiment, a computer-implemented method is provided. The computer-implemented method comprises: receiving, from a device mounted on a shaft of exercise equipment, an indication of a weight of a load attached to the shaft, generated by a load sensor housed in the device; receiving, from a device mounted on a shaft of exercise equipment, a time series descriptive of a trajectory of the load over a period of time, generated by a motion sensor housed in the device; applying, by processing hardware, a set of one or more processing rules to the indication of the weight and to the time series to generate at least one metric of forces applied to move the load along the trajectory; and providing, by the processing hardware, the at least one metric via a user interface of a client device.

In still another embodiment, a tangible, non-transitory computer-readable medium is provided. The tangible, non-transitory computer-readable medium stores executable instructions that, when executed by at least one processor of a computer system, cause the processor to: receive, from a device mounted on a shaft of exercise equipment, an indication of a weight of a load attached to the shaft, generated by a load sensor housed in the device; receive, from a device mounted on a shaft of exercise equipment, a time series descriptive of a trajectory of the load over a period of time, generated by a motion sensor housed in the device; apply a set of one or more processing rules to the indication of the weight and to the time series to generate at least one metric of forces applied to move the load along the trajectory; and provide at least one metric via a user interface of a client device.

BRIEF DESCRIPTION OF THE DRAWINGS

The figures described below depict various aspects of the systems and methods disclosed herein. Advantages will become more apparent to those skilled in the art from the following description of the embodiments which have been shown and described by way of illustration. As will be realized, the present embodiments may be capable of other and different embodiments, and their details are capable of modification in various respects. Accordingly, the drawings and description are to be regarded as illustrative in nature and not as restrictive. Further, wherever possible, the following description refers to the reference numerals included in the following figures, in which features depicted in multiple figures are designated with consistent reference numerals.

DETAILED DESCRIPTION

Figure 1:
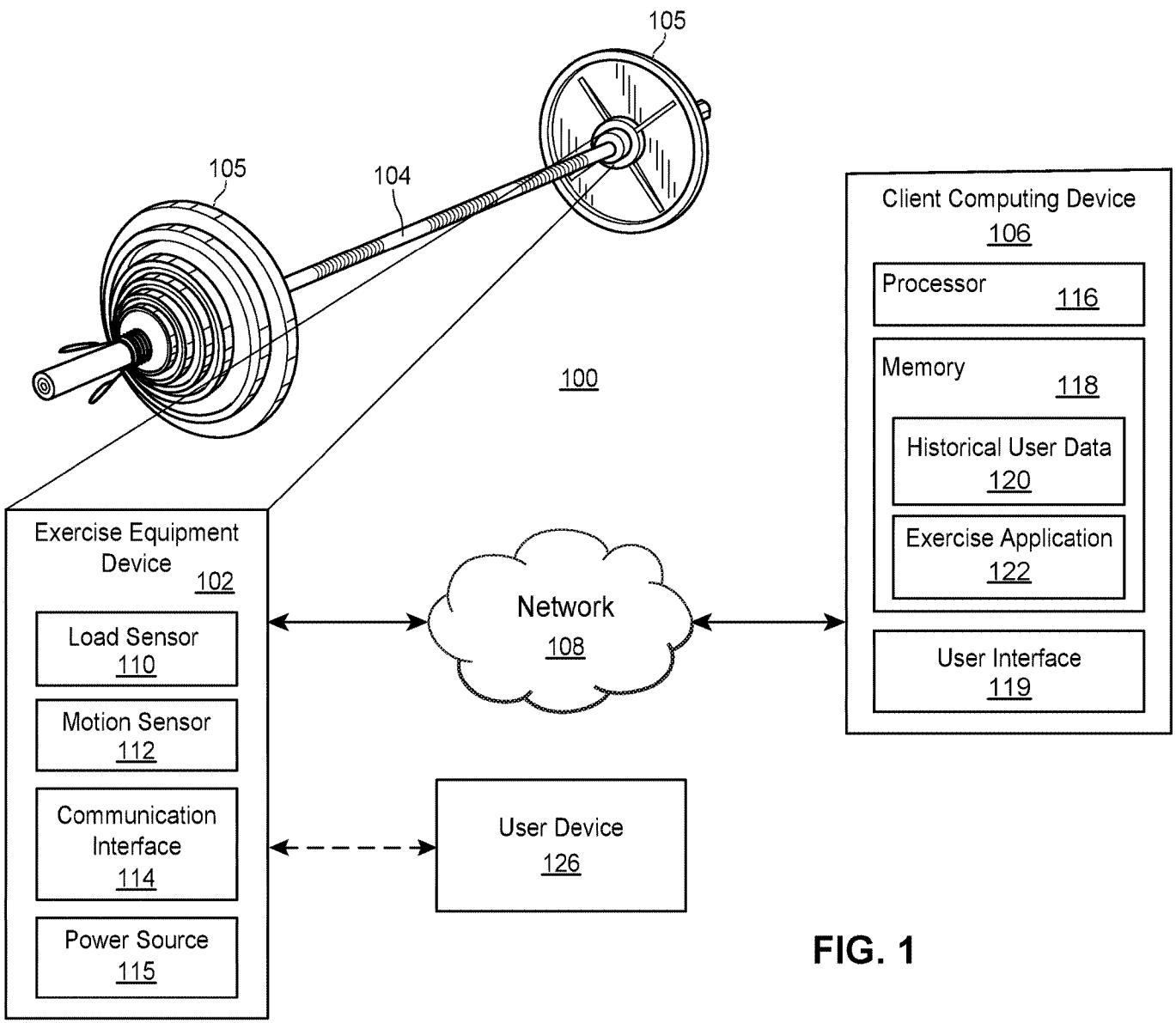
FIG. 1 illustrates a block diagram of an exemplary system for automatically tracking and analyzing sensor data associated with free weights, in accordance with some embodiments.

FIG. 1 illustrates a block diagram of an exemplary system 100 for automatically tracking and analyzing sensor data associated with free weights, in accordance with some embodiments. The high-level architecture illustrated in FIG. 1 may include both hardware and software applications, as well as various data communications channels for communicating data between the various hardware and software components, as is described below.

As shown in FIG. 1, an exercise equipment device 102 may be associated with (e.g., slid on, clasped around, clipped to or hooked onto, magnetically attached to, adhesively attached to, internally stored within, etc.) exercise equipment 104 (e.g., a barbell, curl bar, dumbbell, kettlebell, weight stack, a pulley-based weight system, etc.). Furthermore, in some examples, the device may be frictionally fit or clamped to the shaft of the exercise equipment 104. In the example of FIG. 1, a first portion of a load 105 is disposed on the shaft near a first end of the shaft, a second portion of the load 105 is disposed on the shaft near a second end of the shaft, and the exercise equipment device 102 is attached to the shaft between the first portion of the load 105 and the second portion of the load 105. The exercise equipment device 102 may communicate with a client computing device 108, e.g., via a network 106. The network 106 can be, for example, a local area network (LAN) or a wide area network (WAN) such as the Internet. In some examples, the exercise equipment device 102 may communicate with the client computing device 108 via a short-range communication link, such as a wireless personal area network (WPAN) link, e.g., Bluetooth®. In some examples, the exercise equipment device may also communicate with a user device 126 via a short-range communication link, such as a wireless personal area network (WPAN) link, e.g., Bluetooth®.

The exercise equipment device 102 may include a load sensor 110 (e.g., a load cell and/or a strain sensor), a motion sensor 112 (e.g., an accelerometer, a gyroscope, etc.), a communication interface 114 (e.g., WPAN, WLAN, infrared, etc.) for communicating with the client computing device 108, and a power source 115, such as a battery (e.g., a rechargeable battery, a replaceable battery, etc.), for powering the electronics. For example, the exercise equipment device 102 may comprise a housing, with the load sensor 110, motion sensor 112, and communication interface 114 disposed and/or positioned within the housing. Furthermore, in some examples, the exercise equipment device 102 may additionally include an amplifier (not shown) for the load sensor 110.

The load sensor 110 may be configured to generate an indication of the weight of a load 105 attached to the shaft of the exercise equipment 104. In some examples, the load sensor 110 may be calibrated with the weight of the exercise equipment 104 itself and may generate an indication of the weight of any additional load 105 attached to the exercise equipment. In other examples, the load sensor 110 may generate an indication of the combined weight of the exercise equipment 104 and any load 105 attached thereto. Moreover, in some examples, the indication of the weight of the load 105 may be an indication of the weight of the load 105 attached to the shaft of the exercise equipment 104 over time (e.g., 50 lbs. at a first time, 60 lbs. at a second time, etc.). That is, in some examples, the weight of the load 105 attached to the exercise equipment 104 may change over time (e.g., when the load 105 includes weight lifting chains).

The motion sensor 112 may be configured to generate an indication of motion of the load 105 over time. For example, the indication of motion of the load 105 over time may include an indication of change in position of the load 105 in x, y, and z directions over time, an indication of the velocity of the load 105, an indication of the acceleration of the load 105, etc. For instance, the indication of the motion of the load 105 over time may be a time series descriptive of a trajectory of the load 105 over a period of time.

The communication interface 114 may be configured to transmit an indication of the weight of the load 105 and/or a time series descriptive of a trajectory of the load 105 over a period of time to an external device, e.g., to the client computing device 108.

The client computing device 108 may include processing hardware such as one or more processors 116 (which may be, e.g., microcontrollers and/or microprocessors), a memory 118, and a user interface 119. The memory 118 may be a non-transitory memory and may include one or several suitable memory modules, such as random access memory (RAM), read-only memory (ROM), flash memory, other types of persistent memory, etc. The one or more processors 116 may interact with the memory 118 to obtain, for example, computer-readable instructions stored in the memory 112. For instance, the memory 112 include stored user data 120, as well as instructions for executing an exercise application 122.

For instance, the stored user data 120 may include personal information input by the user, e.g., via the user interface 119. For example, the user may provide information relevant to exercises he or she performs, such as his or her height, weight, gender, etc. Moreover, in some examples, additional external devices, such as, e.g., heart rate monitors or other wearable fitness trackers associated with the user (not shown in FIG. 1), may communicate with the client computing device 108 to provide additional user information (e.g., heart rate data, movement data, etc.), which the client computing device 108 may store as user data 120.

The exercise application 122 may analyze the indication of the weight of the load 105 and/or the time series descriptive of the trajectory of the load 105 over the period of time transmitted to the client device 108 by communication interface 114 of the exercise equipment device 102. In particular, the exercise application 122 may be configured to apply a set of one or more processing rules to the indication of the weight and to the time series descriptive of the trajectory of the load (and/or to the stored user data 120) to generate at least one metric of forces applied to move the load along the trajectory. Moreover, the exercise application 122 may be configured provide the generated metric to a user via the user interface 119 (e.g., in real-time). Additionally, in some examples, the exercise application 122 may be configured to log these metrics in the stored user data 120.

In some examples, the metric may be an indication of a number of sets or repetitions performed with a load having a particular weight (e.g., three sets of ten repetitions using 50pounds, two sets of eight repetitions using 80 pounds, etc.) over a certain period of time, on a particular day, or during the performance of a particular exercise. Moreover, the exercise application 122 may be further configured to provide recommendations related to the generated number of sets or repetitions performed. For example, the exercise application 122 may be configured to identify plateaus in the individual's performance, and/or to identify indications of overtraining or injury, and may provide recommendations (e.g., via the user interface 119) for avoiding plateaus, overtraining, injuries, or other undesirable outcomes based on the generated metric.

Furthermore, in some embodiments, the metric may be an indication of the speed with which the user moves the exercise equipment 104 up and down in his or her performance of an exercise (e.g., a squat, a bench press, etc.). For instance, the trajectory of the load 105 over the period of time may be analyzed to identify a first portion of the trajectory of the load 105 over a first period of time corresponding to an upward motion of the exercise equipment 104, and a second trajectory of the load over a second period of time corresponding to a downward motion of the exercise equipment 104. Furthermore, a first average velocity of the exercise equipment 104 over the first portion of the trajectory of the load 105 over the first period of time and a second average velocity of the exercise equipment 104 over the second portion of the trajectory of the load 105 over the second period of time may be calculated. In some examples, the exercise application 122 may use these velocities to calculate a recommended weight change for the user, and may provide the recommended weight change via the user interface 119. For instance, slower velocities may result in a recommendation to change to lighter weights, while faster velocities may result in a recommendation to change to heavier weights.

Additionally, in some embodiments, the metric may be an indication of the trajectory itself, e.g., a general indication of the shape of the trajectory, or a description of the shape of the trajectory (even, uneven, tilted, etc.).

In some examples, the exercise application 122 may provide the metric to the user numerically, e.g., by displaying a log of the individual's performance of various exercises on various dates, including indications of sets, repetitions, amounts of weight, types of exercises, etc., via the user interface 119. In other examples, the exercise application 122 may provide the metric to the user visually, e.g., by displaying an animation illustrating the trajectory of the load 105 over the period of time via the user interface 119. For instance, in some examples, the animation may include an animation illustrating an expected trajectory of the load 105 for a particular exercise, e.g., so the user may compare the individual's trajectory to the expected trajectory.

Additionally, in some examples, the exercise application 122 may be configured to identify an exercise performed over the period of time, and may provide an indication of the exercise performed over the period of time to the user via the user interface 119 of the client device 108. For instance, the exercise may be identified by comparing the trajectory of the load over the period of time to an expected trajectory of a load over a period of time for a particular exercise. For example, expected trajectories may be stored for various types of exercises that could be performed using the exercise equipment 104 to which the exercise equipment device 102 is attached, and the trajectory of the load over the period of time may be compared to each of the stored trajectories for various types of exercises to determine which of the stored trajectories most closely matches the trajectory based on the captured sensor data. Accordingly, the exercise associated with the closest-matching trajectory may be identified as the exercise being performed.

Furthermore, in some examples, the exercise application 122 may be configured to analyze any variation between the trajectory of the load 105 over the period of time and the expected trajectory for the load 105 over a period of time for a given exercise to identify deficiencies in the form of the individual performing the exercise. For example, by comparing the trajectory of the load 105 over the period of time and the expected trajectory for the load 105 over a period of time for a given exercise, the exercise application 122 may identify an indication that the individual is likely leaning too far forward during the performance of the exercise, an indication that the individual is holding the exercise equipment off-balance, etc. In some examples, the exercise application 122 may be configured to generate a recommendation for the user recommending potential changes the user could make to improve his or her form, (e.g., "Next time, try leaning back more!" or "Next time, try tilting less to the left!", "Make sure to center the weight on your shoulders!", etc.), and may provide the recommendation as a notification displayed via the user interface 119 of the client computing device 108.

Moreover, in some examples, the exercise application 122 may be configured to identify the individual performing the exercise. For instance, a user may be identified by verifying credentials (e.g., a password, a fingerprint login, a retina scan, etc.) provided by the user via the client computing device 108, and the fact that the user is performing the exercise may be determined based on the proximity of the user to the exercise equipment device 102. For instance, an indication of the proximity of the client computing device 108 to the exercise equipment device may be identified when the exercise equipment device 102 detects a short range signal (e.g., a Bluetooth® signal) transmitted by the computing device 108, or vice versa. In another example, the client computing device 108 and the exercise equipment device 102 may each include respective location sensors, such as, e.g., GPS sensors, and an indication of the proximity of the client computing device 108 to the exercise equipment device 102 may be determined when the devices' respective location sensors indicate coordinates that are close in proximity (e.g., within a threshold distance of one another).

In some examples, an indication of the proximity of the user to the exercise equipment device 102 may be determined based on the proximity of another user device (e.g., an additional or alternative device distinct from the client computing device 108) to the exercise equipment device 102. For example, some users may not take client computing devices 108 to gyms while they exercise, or otherwise may not have a client computing device 108 nearby while they exercise.

For instance, the user's device 126 could be a water bottle or exercise shoe or other item associated with exercise (or a device attached to one of these items) associated with the individual and configured to emit a short-range signal detectable by the exercise equipment device 102 (e.g., via Bluetooth®). For instance, the user's device 126 may include an embedded or attached short-range signal transmitter uniquely associated with the user.

Moreover, the computer-readable instructions stored on the memory 112 may include instructions for carrying out any of the steps of the method 700, described in greater detail below with respect to FIG. 7. Furthermore, the computer-readable instructions stored on the memory 112 may include instructions for executing additional or alternative applications in various embodiments.

FIGS. 2A-21 illustrate several exemplary views of an example exercise equipment device 102 having a housing with separate compartments for multiple sensors, and configured to be mounted on a shaft of exercise equipment 104, operable within the system illustrated in FIG. 1, in accordance with some embodiments. As shown in FIGS. 2A-21, the exercise equipment device 102 may comprise a rounded housing 202 with a hole 204 therethrough to receive an end of the shaft 206 of the exercise equipment. The housing may be made of a lightweight material, such as plastic (or in some examples, carbon fiber or metal) and may be generally internally hollow, with evenly spaced interior compartments 208A for housing various sensors. In some examples, the load sensor 110, motion sensor 112, communication interface 114, and/or power source 115 described with respect to FIG. 1 (and/or a processor or microprocessor) may be disposed within the interior compartments 208A illustrated at FIG. 2C. In other examples, the motion sensor 112 and communication interface 114 may be disposed within the interior compartments 208A illustrated at FIG. 2C, while the load sensor(s) 110 are adhesively attached to the exterior of the exercise equipment 104.

Advantageously, the lightweight hollow housing 202 of the exercise equipment device 102 generally will not add significant weight to the exercise equipment 104. Furthermore, the evenly spaced interior compartments 208A allow for a generally even distribution of sensor weight around the interior of the housing 202.

In some examples, the housing 202 of the exercise equipment device 102 may be attached to the shaft 206 of the exercise equipment 104, e.g., using an adhesive such as a glue or an epoxy. Furthermore, in some examples, the housing 202 may be frictionally fit or clamped to the shaft 206 of the exercise equipment 104. In some examples, the housing 202 of the exercise equipment device 102 may be configured to slide on to the shaft 206 of the exercise equipment 104, while in other examples, the housing 202 of the exercise equipment device 102 may be configured to clasp around the shaft 206 of the exercise equipment 104. Beneficially, in many examples, the exercise equipment device 102 may be easily retrofitted to existing exercise equipment 104. Accordingly, users of the exercise equipment device 102 generally will not need to obtain additional exercise equipment in order to use the exercise equipment device 102 to track their exercises in an existing gym.

Furthermore, in some examples, because the housing 202 of the exercise equipment device 102 may be easily slid or clasped onto the shaft 206 of the exercise equipment 104 as needed, the exercise equipment device 102 may be easily transferred between different exercise equipment 104 as needed by a user. For example, a user who switches from one piece of exercise equipment 104 to another, or even from gym to another, may remove the exercise equipment device 102 from a previous barbell and fit the exercise equipment device 102 to new barbell as needed, e.g., by sliding the exercise equipment device 102 off of the previous barbell and sliding the exercise equipment device 102 onto the new barbell, or by unclasping the exercise equipment device 102 from the previous barbell and clasping the exercise equipment device 102 around a new barbell.

Figure 3:
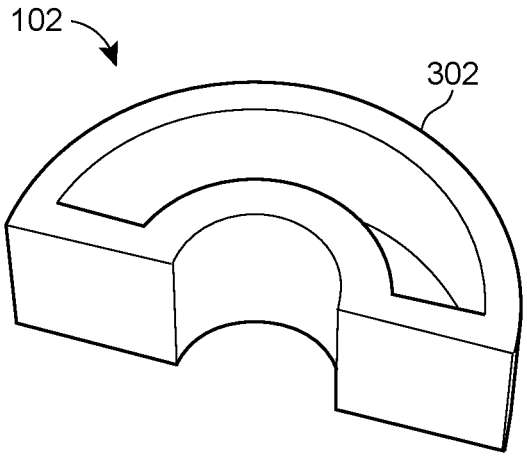
FIG. 3 illustrates an exemplary view of an exercise equipment device configured to be magnetically attached to a shaft of a piece of exercise equipment, operable within the system illustrated in FIG. 1, in accordance with some embodiments.

FIG. 3 illustrates an exemplary view of a housing 302 of an example exercise equipment device 102 configured to be magnetically or adhesively attached to a shaft of a piece of exercise equipment 104, operable within the system illustrated in FIG. 1, in accordance with some embodiments. For instance, because the exercise equipment device 102 as shown in FIG. 3 is configured to be magnetically or adhesively attached to a piece of exercise equipment 104, there is no need for the device to fully wrap around the entire piece of exercise equipment 104. Accordingly, the overall size of the exercise equipment device 102 as shown in FIG. 3 may be smaller. Furthermore, in some examples, the housing 302 as shown in FIG. 3 may be one of two parts of the exercise equipment device 102, i.e., two complementary portions of the exercise equipment device 102 configured to be magnetically or adhesively attached to either side of a shaft of the exercise equipment 104.

Figure 4:
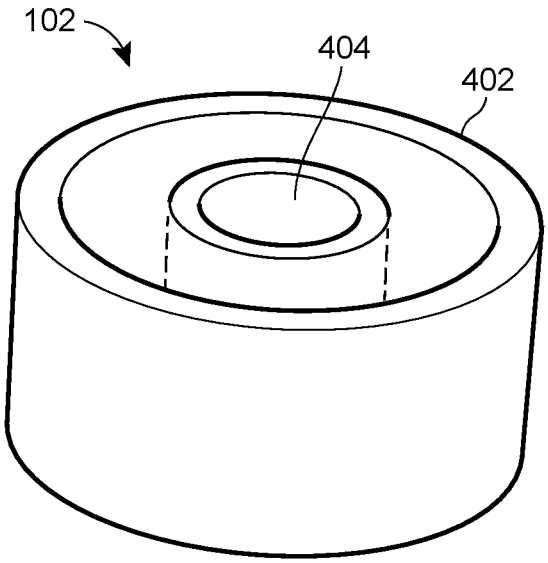
FIG. 4 illustrates an exemplary view of an exercise equipment device having a housing for storing a chip including multiple sensors, and configured to be mounted on a shaft of exercise equipment, operable within the system illustrated in FIG. 1, in accordance with some embodiments.
Figure 5A:
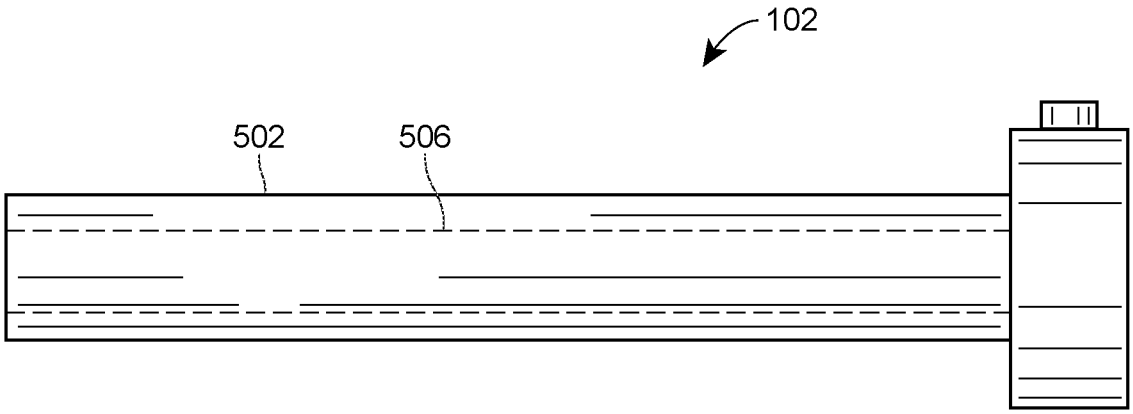
FIGS. 5A-5D illustrate several exemplary views of an exercise equipment device sleeve mountable on a shaft of exercise equipment, operable within the system illustrated in FIG. 1, in accordance with some embodiments.
Figure 5B:
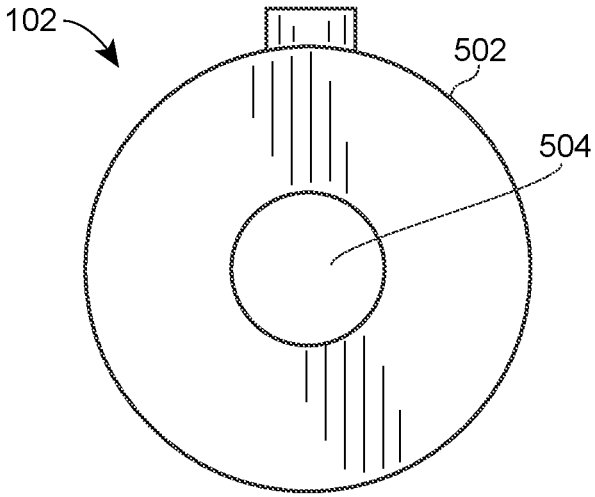
Figure 5C:
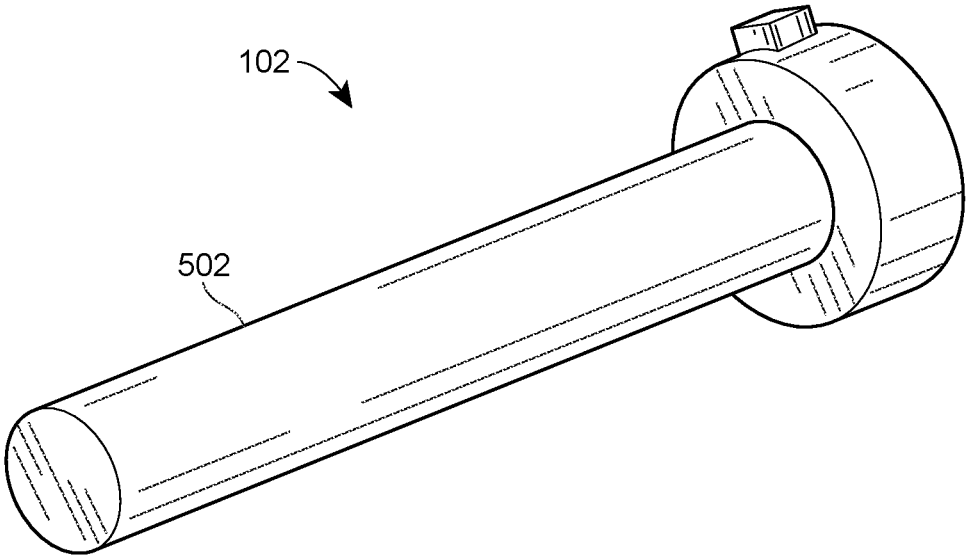
Figure 5D:
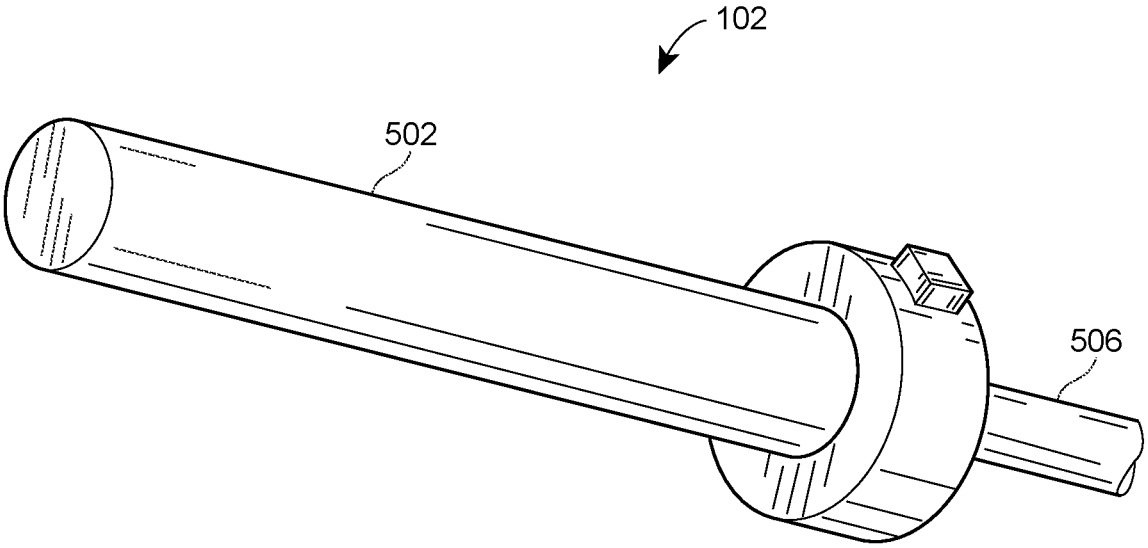

FIG. 4 illustrates an exemplary view of an example exercise equipment device 102 having a rounded housing 402 with a hole 404 therethrough to receive an end of the shaft of the exercise equipment 104. In particular, the housing 402 may be configured to store a chip including multiple sensors and other components of the exercise equipment device 102, and configured to be mounted on a shaft of a piece of exercise equipment 104, operable within the system illustrated in FIG. 1, in accordance with some embodiments. In some examples, the chip may include the load sensor 110 (e.g., a load cell), the motion sensor 112, the communication interface 114, and/or the power source 115 described with respect to FIG. 1 (as well as a processor or microprocessor, in some examples). In other examples, the chip may include some of the sensors and/or other components of the exercise equipment device 102, while the load sensor(s) 110 are adhesively attached to the exterior of the exercise equipment 104. In any case, because the sensors and other components housed within the exercise equipment device 102 are included in a single chip, there is no need for multiple compartments to hold each sensor in place within the housing 402 of the exercise equipment device 102 as shown in FIG. 4.

Figure 2A:
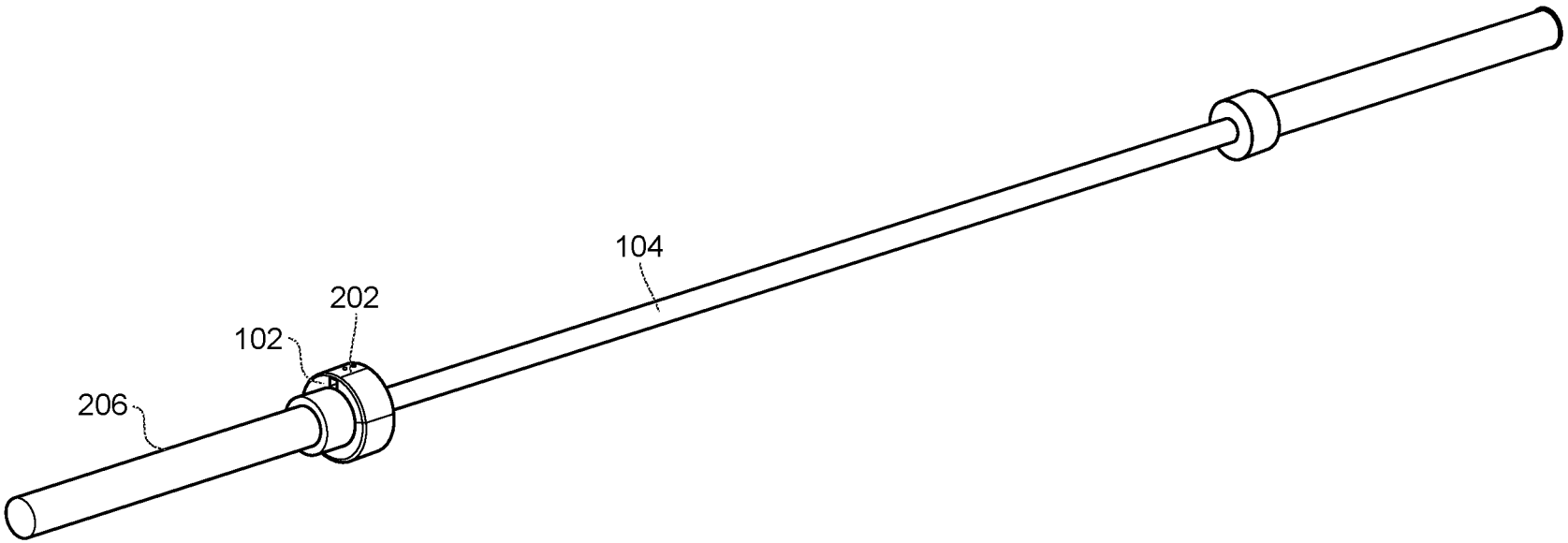
FIGS. 2A-2I illustrate several exemplary views of an exercise equipment device having a housing with separate compartments for multiple sensors, and configured to be mounted on a shaft of exercise equipment, operable within the system illustrated in FIG. 1, in accordance with some embodiments.
Figure 2B:
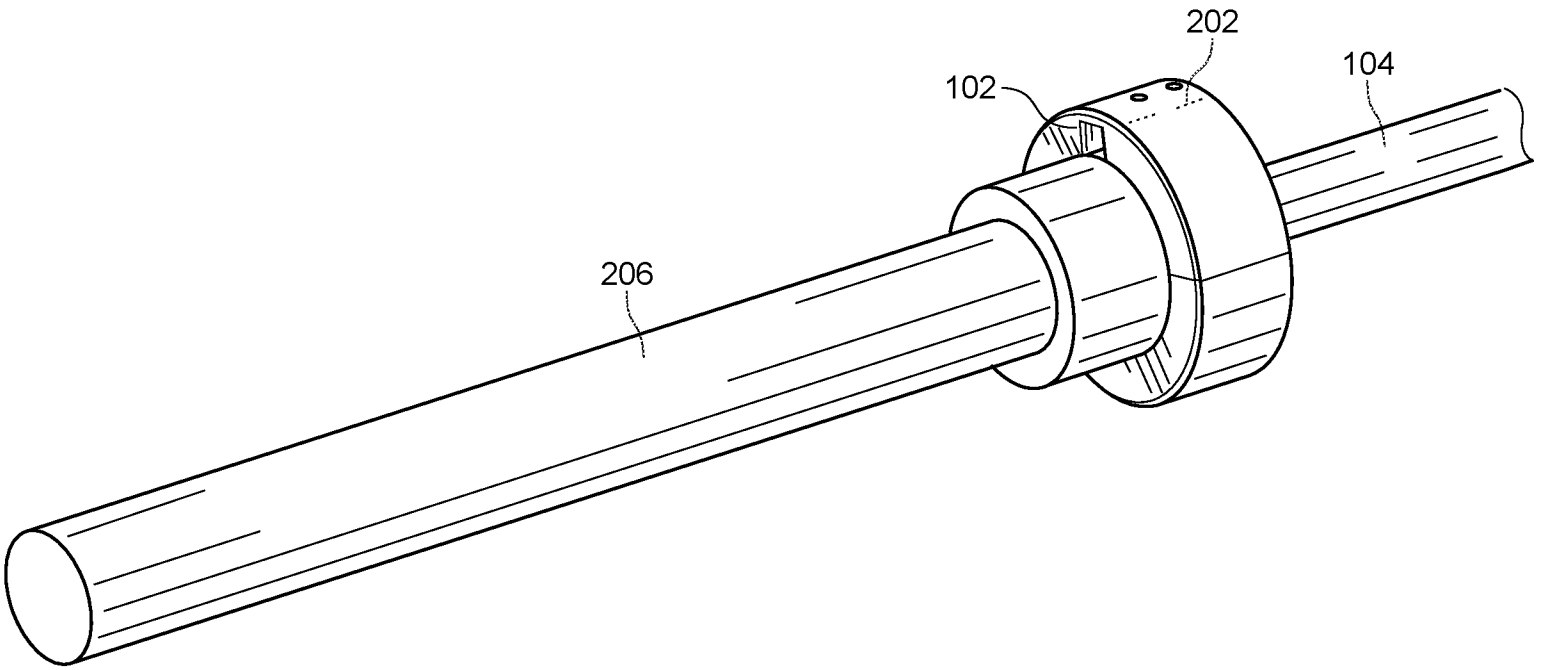
Figure 2C:
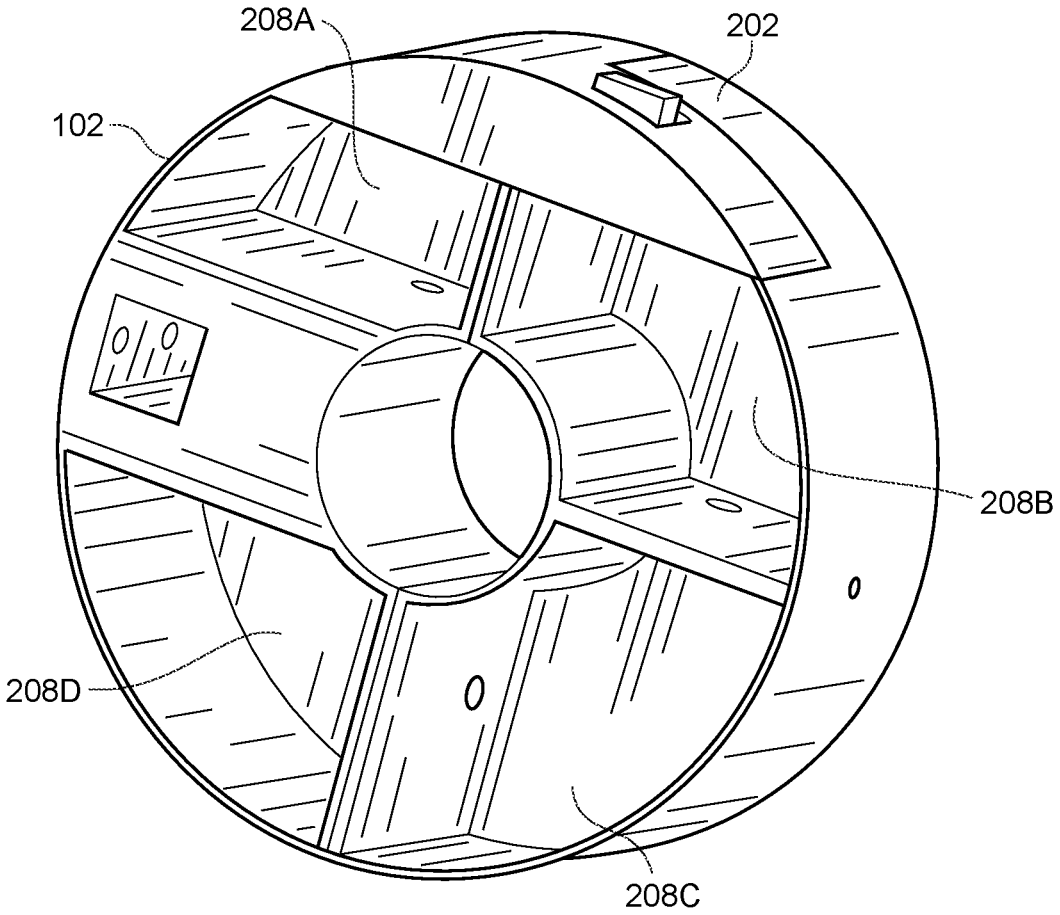
Figure 2D:
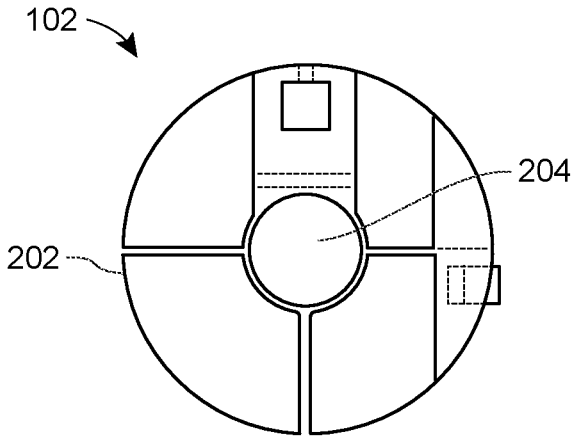
Figure 2E:
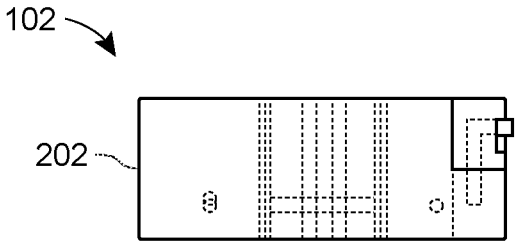
Figure 2F:
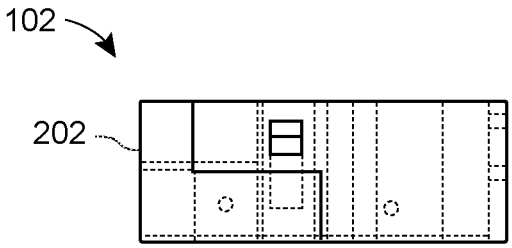
Figure 2G:
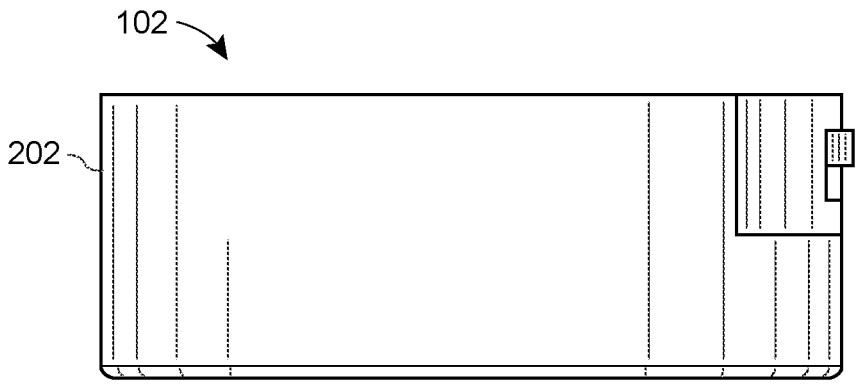
Figure 2H:
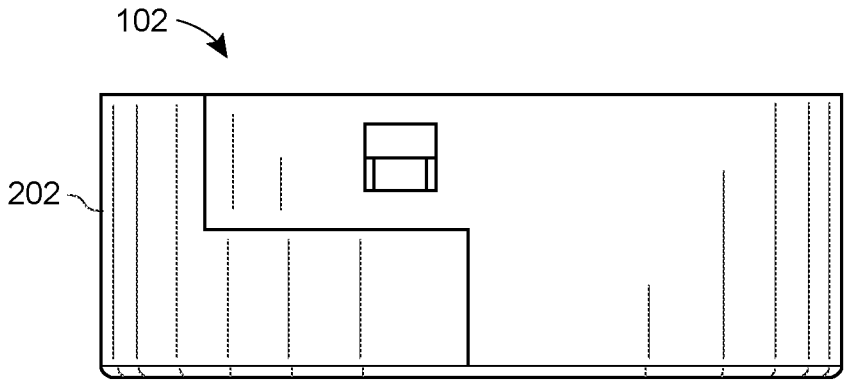
Figure 2I:
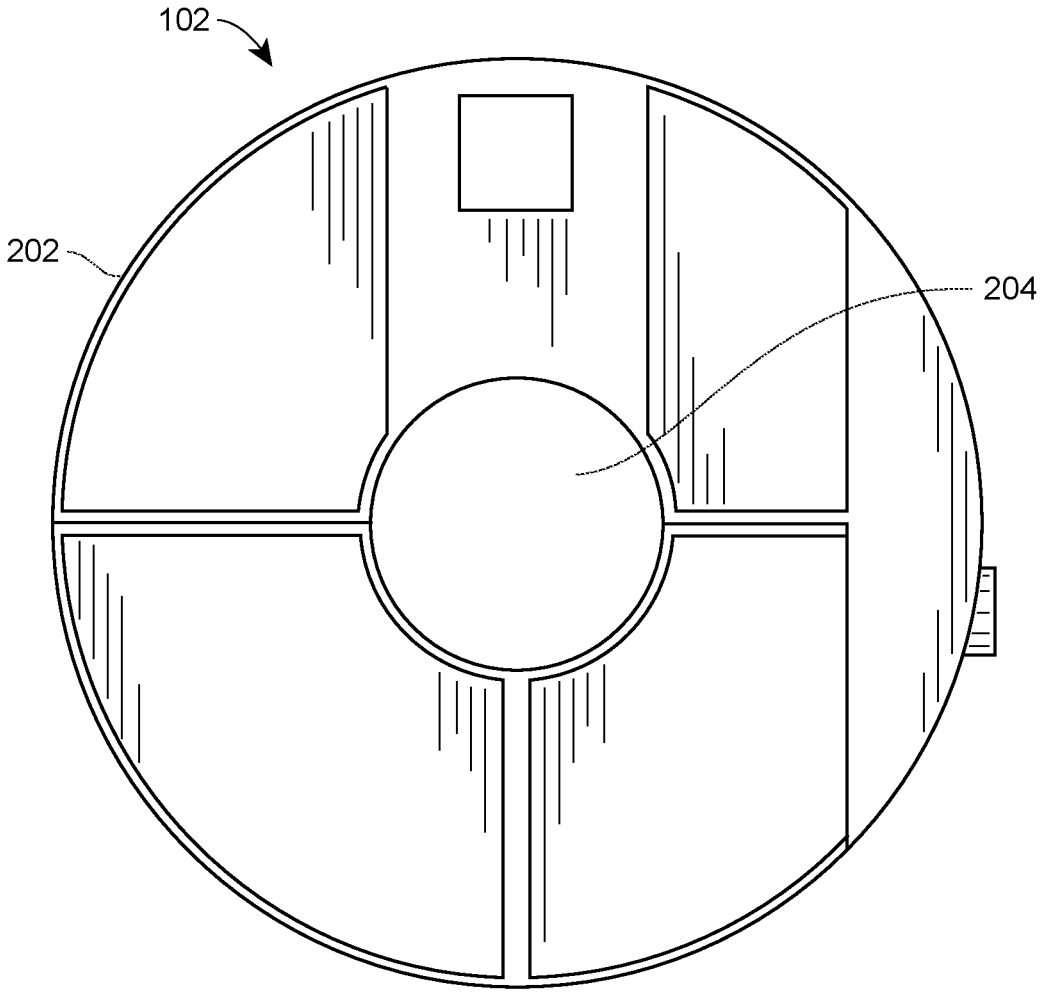

FIGS. 5A-5D illustrate several exemplary views of a sleeve 502 of an example exercise equipment device 102. The sleeve 502 may be mountable on a shaft 506 of a piece of exercise equipment 104, operable within the system illustrated in FIG. 1, in accordance with some embodiments. That is, the exercise equipment device 102 as shown in FIGS. 5A-5D may form a sleeve 502 configured to fit around the shaft 506 of the exercise equipment 104. In some examples, the sleeve 502 of the exercise equipment device 102 may include compartments for various sensors and other components (e.g., load sensor 110, motion sensor 112, communication interface 114, and/or power source 115 described with respect to FIG. 1, and/or a processor or microprocessor), e.g., like the compartments 208A as shown in FIG. 2C, while in other examples, the exercise equipment device sleeve 102 may include no compartments or one compartment for a chip including multiple sensors or other components, e.g., as discussed with respect to the housing 402 of FIG. 4. For instance, the chip may include the load sensor 110, motion sensor 112, communication interface 114, and/or the power source 115, as well as a processor or microprocessor. Furthermore, in some examples, the compartments or the chip may include the motion sensor 112 and communication interface 114, and/or power source 115, while the load sensor(s) 110 are adhesively attached to the exterior of the exercise equipment 104. Additionally, in some examples, the motion sensor 112, communication interface 114, and/or power source 115 may be included within a housing portion of the exercise equipment device 102 while the load sensors 110 are included within the sleeve 502 of the exercise equipment device 102.

Figure 6A:
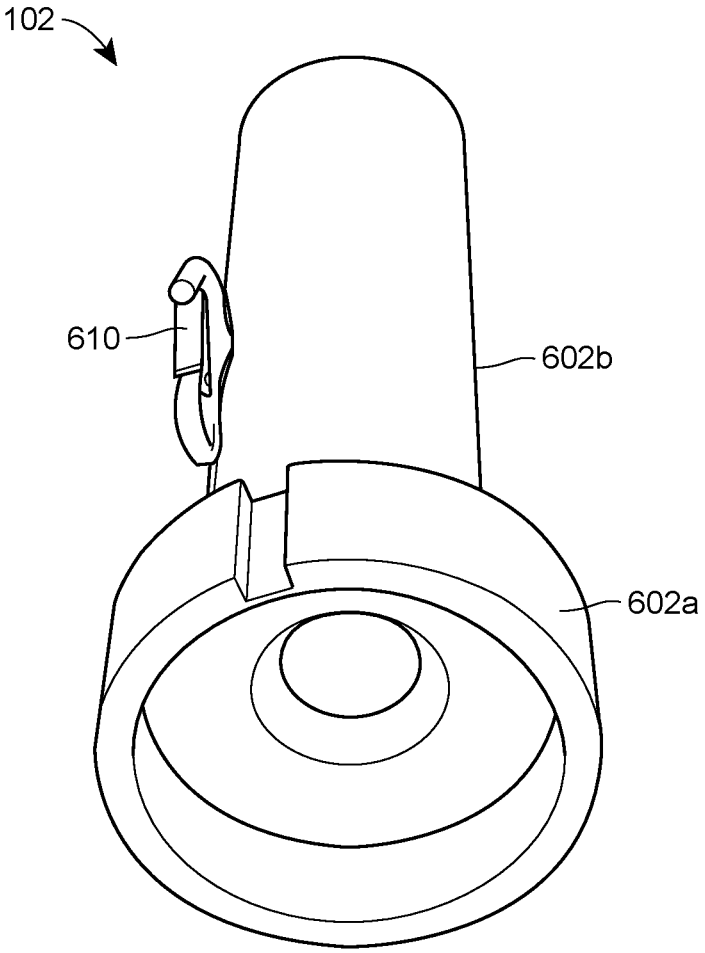
FIGS. 6A and 6B illustrate several exemplary views of a detachable two-part exercise equipment device sleeve mountable on exercise equipment, operable within the system illustrated in FIG. 1, in accordance with some embodiments.
Figure 6B:
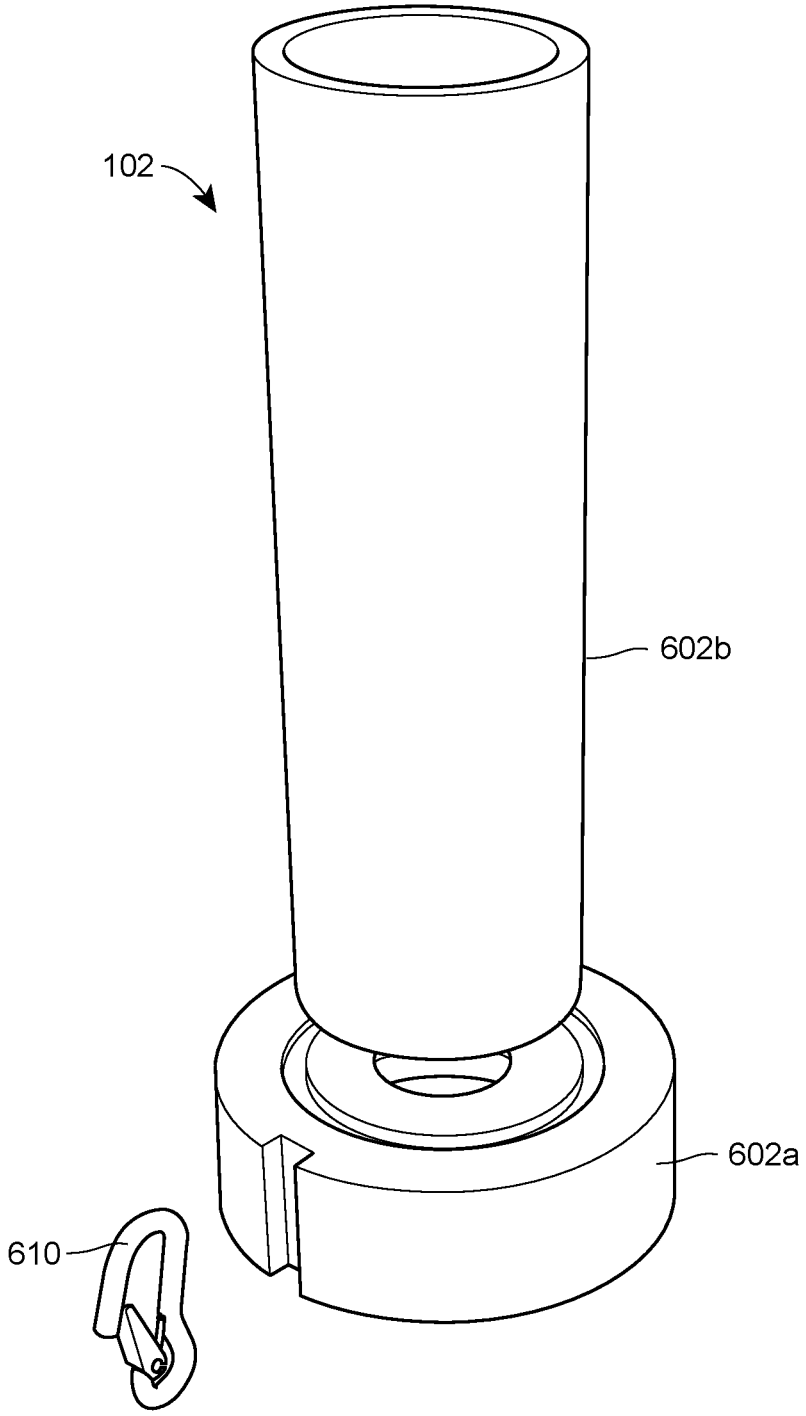

FIGS. 6A and 6B illustrate several exemplary views of an example detachable sleeve of an exercise equipment device 102 having two portions 602A and 602B. The detachable two-part sleeve 602A, 602B may be mountable on a piece of exercise equipment 104, operable within the system illustrated in FIG. 1, in accordance with some embodiments. For example, a first part 602A of the sleeve of the exercise equipment device 102 may be clipped (e.g., using clip 610) to a second part 602B of the sleeve of the exercise equipment device 102, e.g., for use in a piece of exercise equipment 102 that uses a pulley system, such as a "lat pulldown" machine. For instance, a first part 602A of the sleeve of the exercise equipment device 102 may contain some components or sensors, such as the motion sensor 112, the communication interface 114, the power source 115, a processor or microprocessor, etc., while a second part 602B of the sleeve of the exercise equipment device 102 may contain other components or sensors, such as a load sensor 110.

Figure 7:
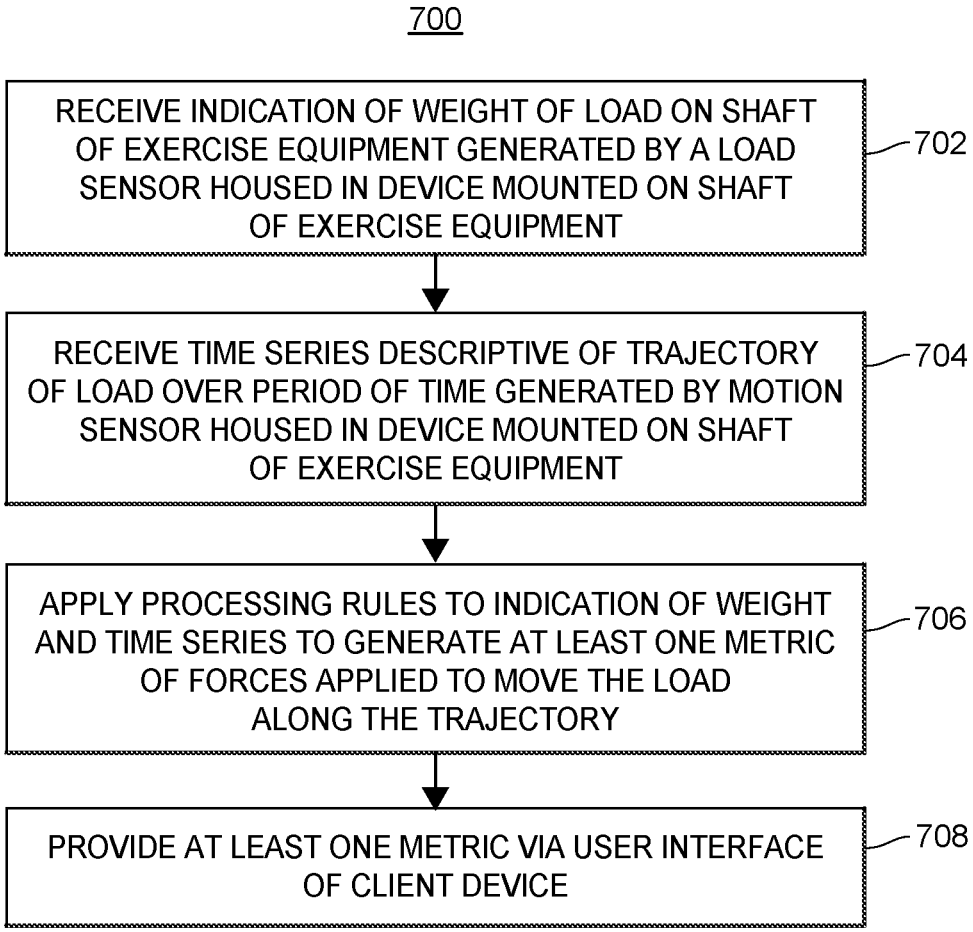
FIG. 7 illustrates a flow diagram of an exemplary method for automatically tracking and analyzing sensor data associated with free weights, in accordance with some embodiments.

FIG. 7 illustrates a flow diagram of an exemplary method 700 for automatically tracking and analyzing sensor data associated with free weights, in accordance with some embodiments. One or more steps of the method 700 may be implemented as a set of instructions stored on a computer-readable memory 118 and executable on one or more processors 116.

An indication of a weight of a load attached to a shaft of exercise equipment (e.g., a barbell, a dumbbell, a kettlebell, etc.) may be received (block 702) from a device mounted on the shaft of the exercise equipment. For instance, the device may transmit the indication over a short-range wireless interface, or via a network (such as, e.g., a WiFi network). The indication of the weight of the load may be generated by a load sensor housed in the device. For instance, the load sensor may include a load cell sensor configured to measure strain on the shaft due to the load. A time series descriptive of a trajectory of the load over a period of time may be received (block 704) from the device mounted on the shaft of the exercise equipment. For example, the time series may be generated by a motion sensor (e.g., an accelerometer or a gyroscope) housed in the device. A set of one or more processing rules may be applied (block 706) to the indication of the weight and to the time series to generate at least one metric of forces applied to move the load along the trajectory. The at least one metric may be provided (block 708) to a user via a user interface of a client device.

Although the preceding text sets forth a detailed description of numerous different embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning.

Throughout this specification, unless indicated otherwise, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may likewise be implemented as a combined structure or component. Similarly, structures and functionality presented as a single component may be implemented as separate components. These and other variations, modifications, additions, and improvements fall within the scope of the subject matter herein.

Additionally, certain embodiments are described herein as including logic or a number of routines, subroutines, applications, or instructions. These may constitute either software (code embodied on a non-transitory, tangible machine-readable medium) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Hardware modules can provide information to, and receive information from, other hardware modules. Accordingly, the described hardware modules may be regarded as being communicatively coupled. Where multiple such hardware modules exist contemporaneously, communications may be achieved through signal transmission (e.g., over appropriate circuits and buses) that connects the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, in some embodiments, the methods or routines described herein may be at least partially processor-implemented. For example, at least some of the operations of a method may be performed by one or more processors or processor-implemented hardware modules. The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The appearances of the phrase "in one embodiment" or "in some embodiments" in various places in the specification are not necessarily all referring to the same embodiment or embodiments.

Some embodiments may be described using the terms "coupled," "connected," "communicatively connected," or "communicatively coupled," along with their derivatives. These terms may refer to a direct physical connection or to an indirect (physical or communication) connection. For example, some embodiments may be described using the term "coupled" to indicate that two or more elements are in direct physical or electrical contact. The term "coupled," however, may also mean that two or more elements are not in direct contact with each other, but yet still co-operate or interact with each other. Unless expressly stated or required by the context of their use, the embodiments are not limited to direct connection.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the words "a" or "an" are employed to describe elements and components of the embodiments herein. This is done merely for convenience and to give a general sense of the description. This description, and the claims that follow, should be read to include one or at least one, and the singular also includes the plural unless the context clearly indicates otherwise.

Upon reading this disclosure, those of skill in the art will appreciate still additional alternative structural and functional designs for tracking and analyzing sensor data associated with free weights. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

The particular features, structures, or characteristics of any specific embodiment may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

Finally, the patent claims at the end of this patent application are not intended to be construed under 35 U.S.C. § 112(f), unless traditional means-plus-function language is expressly recited, such as "means for" or "step for" language being explicitly recited in the claims.

What is claimed is:

1. A device mountable on a shaft of exercise equipment, the device comprising:

a housing with a hole therethrough to receive the shaft, the housing configured to be clasped around, magnetically attached to, or adhesively attached to the shaft between a first portion of a load attached to the shaft via a first end of the shaft and a second portion of the load attached to the shaft via a second end of the shaft;

a load sensor disposed in a first compartment of the housing and configured to generate an indication of weight of the load attached to the shaft;

a motion sensor disposed in a second compartment of the housing and configured to generate an indication of motion of the load at a corresponding time; and an interface disposed in the housing and configured to transmit, to an external device, (i) the indication of weight of the load and (ii) a time series descriptive of a trajectory of the load over a period of time.

2. The device of claim 1, wherein the load sensor includes a load cell sensor configured to measure strain on the shaft due to the load.

3. The device of claim 1, wherein the motion sensor includes at least one of an accelerometer or a gyrometer.

4. The device of claim 1, wherein the interface is configured to transmit over a short-range wireless interface.

5. The device of claim 1, wherein the interface is configured to receive, over a short-range wireless interface, an indication of an identification of a user device proximate to the device during the time series, and transmit the indication of the identification of the user device to the external device.

6. The device of claim 5, wherein the user device is the external device.

7. The device of claim 1, wherein the housing forms a sleeve around the shaft.

8. A computer-implemented method comprising:

receiving, from a device mounted on a shaft of exercise equipment, wherein the device is clasped around, magnetically attached to, or adhesively attached to the shaft between a first portion of a load attached to the shaft via a first end of the shaft and a second portion of the load attached to the shaft via a second end of the shaft, an indication of a weight of the load attached to the shaft, generated by a load sensor housed in a first compartment of the device;

receiving, from the device mounted on the shaft of the exercise equipment, a time series descriptive of a trajectory of the load over a period of time, generated by a motion sensor housed in a second compartment of the device;

applying, by processing hardware, a set of one or more processing rules to the indication of the weight and to the time series to generate at least one metric of forces applied to move the load along the trajectory; and providing, by the processing hardware, the at least one metric via a user interface of a client device.

9. The computer-implemented method of claim 8, further comprising:

identifying, by a processor, an exercise performed over the period of time by comparing the trajectory of the load over the period of time to an expected trajectory of a load over a period of time for a particular exercise.

10. The computer-implemented method of claim 9, further comprising:

determining, based on the comparison, one or more differences between the trajectory of the load over the period of time and the expected trajectory of the load over a period of time for the particular exercise.

11. The computer-implemented method of claim 8, further comprising:

analyzing, by a processor, the trajectory of the load over the period of time to identify a first portion of the trajectory of the load over a first period of time corresponding to an upward motion of the exercise equipment and a second trajectory of the load over a second period of time corresponding to a downward motion of the exercise equipment; and calculating, by a processor, a first average velocity of the exercise equipment over the first portion of the trajectory of the load over the first period of time and a second average velocity of the exercise equipment over the second trajectory of the load over the second period of time.

12. The computer-implemented method of claim 8, further comprising:

generating, by a processor, an animation illustrating the trajectory of the load over the period of time; and displaying, by a user interface, the animation illustrating the trajectory of the load over the period of time.

13. The computer-implemented method of claim 8, further comprising:

receiving, by a processor, an indication of an identification of a user device proximate to the device mounted on the shaft of the exercise equipment during the time series.

14. The computer-implemented method of claim 13, wherein the user device is the client device.

15. A tangible, non-transitory computer-readable medium storing executable instructions that, when executed by at least one processor of a computer system, cause the processor to:

receive, from a device mounted on a shaft of exercise equipment, wherein the device is clasped around, magnetically attached to, or adhesively attached to the shaft between a first portion of a load attached to the shaft via a first end of the shaft and a second portion of the load attached to the shaft via a second end of the shaft, an indication of a weight of the load attached to the shaft, generated by a load sensor housed in a first compartment of the device;

receive, from the device mounted on the shaft of the exercise equipment, a time series descriptive of a trajectory of the load over a period of time, generated by a motion sensor housed in a second compartment of the device;

apply a set of one or more processing rules to the indication of the weight and to the time series to generate at least one metric of forces applied to move the load along the trajectory; and provide at least one metric via a user interface of a client device.

16. The tangible, non-transitory computer-readable medium of claim 15, wherein the executable instructions further cause the processor to:

identify an exercise performed over the period of time by comparing the trajectory of the load over the period of time to an expected trajectory of a load over a period of time for a particular exercise.

17. The tangible, non-transitory computer-readable medium of claim 15, wherein the executable instructions further cause the processor to:

analyze the trajectory of the load over the period of time to identify a first portion of the trajectory of the load over a first period of time corresponding to an upward motion of the exercise equipment and a second trajectory of the load over a second period of time corresponding to a downward motion of the exercise equipment; and calculate a first average velocity of the exercise equipment over the first portion of the trajectory of the load over the first period of time and a second average velocity of the exercise equipment over the second trajectory of the load over the second period of time.

18. The tangible, non-transitory computer-readable medium of claim 15, wherein the executable instructions further cause the processor to:

generate an animation illustrating the trajectory of the load over the period of time; and cause a user interface to display the animation illustrating the trajectory of the load over the period of time.

19. The tangible, non-transitory computer-readable medium of claim 15, wherein the executable instructions further cause the processor to:

receive an indication of an identification of a user device proximate to the device mounted on the shaft of the exercise equipment during the time series.

20. The tangible, non-transitory computer-readable medium of claim 19, wherein the user device is the client device.

* * * * *